United States Patent [19]

Jolley et al.

[11] 4,014,278

[45] Mar. 29, 1977

[54] NEEDLE BARS FOR TUFTING MACHINES

[75] Inventors: Paul E. Jolley, Chattanooga, Tenn.; Harvey M. Wooten, Rising Fawn, Ga.

[73] Assignee: The Singer Company, New York, N.Y.

[22] Filed: Sept. 8, 1976

[21] Appl. No.: 720,484

[52] U.S. Cl. ..... 112/226; 112/79 R; 112/221

[51] Int. Cl.[2] ..... D05B 55/02; D05C 15/00

[58] Field of Search ..... 112/221, 226, 79 R, 112/218 R, 222

[56] References Cited

UNITED STATES PATENTS

| | | | |
|---|---|---|---|
| 1,075,743 | 10/1913 | Woodward | 112/226 |
| 1,401,466 | 12/1921 | De Voe | 112/226 |
| 2,563,916 | 8/1951 | Brussell | 112/79 R X |
| 3,485,195 | 12/1969 | Torrence | 112/226 |

*Primary Examiner*—H. Hampton Hunter
*Attorney, Agent, or Firm*—Edward L. Bell; Robert E. Smith; Alan Ruderman

[57] ABSTRACT

A tufting machine having a needle bar for mounting a multiplicity of needles reciprocable into and out of a work piece. The needle bar has a longitudinally extending channel open to face the work piece for securely receiving an insert spaced from the longitudinally extending walls of the channel. The insert includes a multiplicity of grooves facing the respective longitudinally extending wall, and a needle is securely received intermediate each of the grooves and the corresponding wall.

3 Claims, 4 Drawing Figures

NEEDLE BARS FOR TUFTING MACHINES

BACKGROUND OF THE INVENTION

This invention relates to tufting machines and more particularly to a needle bar for such machines for mounting a multiplicity of tufting machine needles at a closer spacing than has heretofor been economically practical for producing very fine gauge pile fabric.

There has long been a need for fine gauge tufted pile fabric. Tufted fabric is considered to be fine gauge when the gauge or spacing between the rows of tufts is one tenth inch and less. However, as the gauge parts including the needles are spaced closer together manufacturing problems are encountered. For example, conventional needle bars have a multiplicity of holes for receiving the respective needles. These holes must be accurately spaced and drilled for the desired gauge. Since fine gauge pile fabric requires fine gauge needles, the hole sizes as well as the spacing between the holes are very small. However, the smaller diameter drills tend to wander from the center of the hole as the holes are cut. Thus, the manufacture of a needle bar with accurately drilled and closely spaced holes is difficult and therefore expensive.

SUMMARY OF THE INVENTION

In order to overcome the aforesaid problem, the present invention provides a needle bar for a tufting machine that does not require the drilling of needle receiving holes. The invention provides a needle bar having a longitudinally extending channel for receiving an insert narrower than the channel and having a multiplicity of grooves facing at least one longitudinally extending wall of the channel for mounting the needles between the grooves and the wall. The channel and the grooves may be formed by milling. Thus, the spacing between adjacent needles or gauge can be very accurately controlled and yet the needle bars can be relatively inexpensively produced.

It is therefore a primary object of this invention to provide an economical needle bar for a tufting machine in which accurate needle mounting means are provided at very fine gauge spacing.

It is another object of this invention to provide a needle bar for a fine gauge tufting machine which needle bar does not have drilled needle receiving holes.

It is a further object of this invention to provide a fine gauge needle bar having a longitudinally extending channel for receiving an insert having a multiplicity of needle accommodating grooves facing at least one longitudinally extending wall of the channel for supporting the needles between the grooves and the wall.

BRIEF DESCRIPTION OF THE DRAWINGS

Other objects and advantages of this invention will best be understood upon reading the following detailed description of the invention with accompanying drawings, in which.

DESCRIPTION OF THE PREFERRED EMBODIMENT

Figure 1:
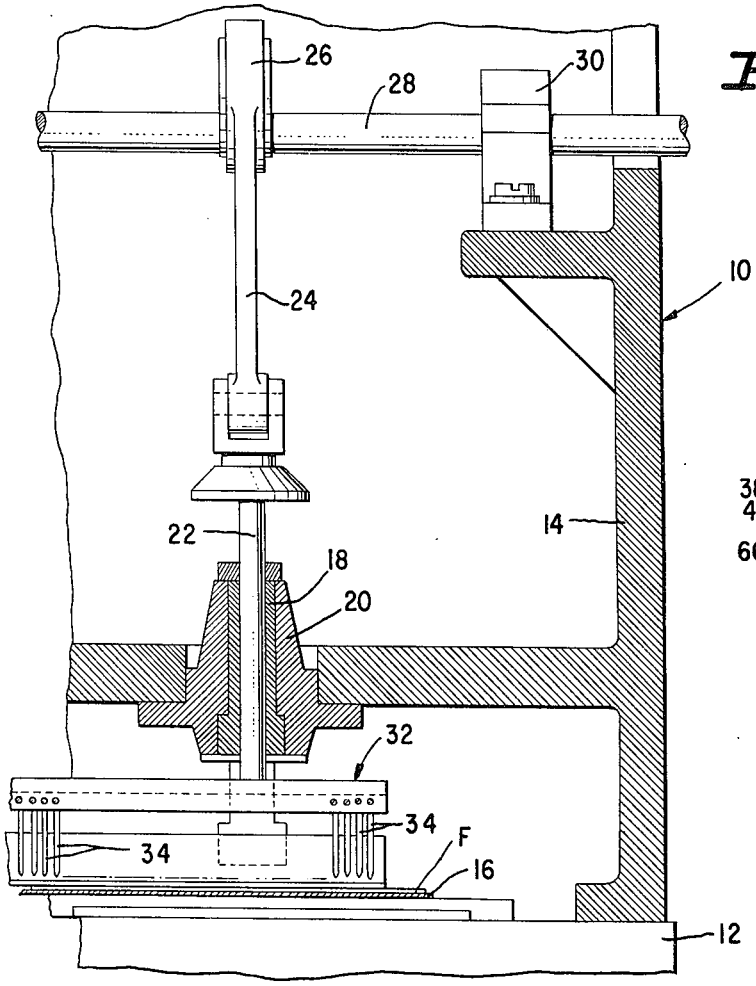
FIG. 1 is a fragmentary sectional view through a tufting machine having a needle bar constructed in accordance with the present invention.
Figure 4:
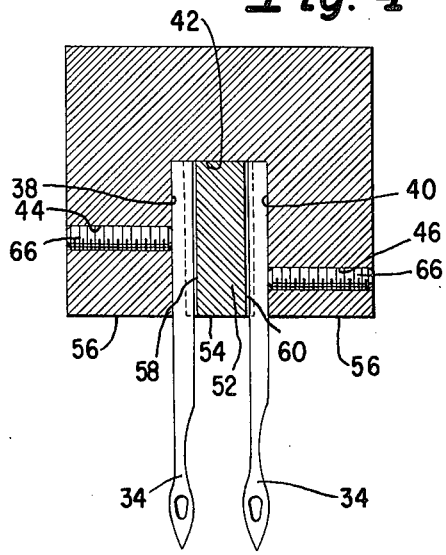
FIG. 4 is a sectional view of the new needle bar taken substantially along line 4—4 of FIG. 3.
Figure 2:
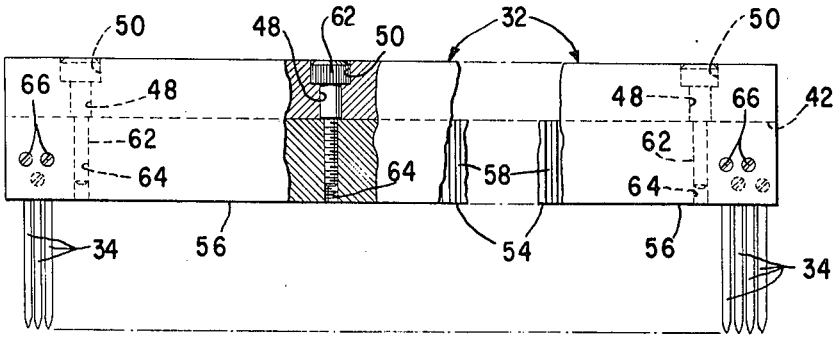
FIG. 2 is an elevational view partially broken away of the needle bar illustrated in FIG. 1.
Figure 3:
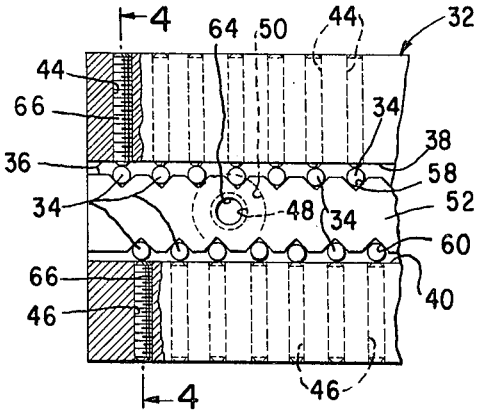
FIG. 3 is a fragmentary bottom plan view of the needle bar illustrated in FIG. 2.

Referring now to the drawings there is illustrated a portion of a tufting machine having a generally conventional frame 10 including a bed 12 and a head 14 disposed above the bed. The bed includes a needle plate 16 over which a backing fabric F is adapted to be fed in a conventional manner.

Mounted in the head for a vertical reciprocation within longitudinally spaced bushings 18 of collar assemblies 20 is one of a plurality of push rods 22. For convenience of illustration, only one such assembly is illustrated. Endwise reciprocation is imparted to each push rod 22 by a link 24 which is pivotally connected at its lower end to the push rod 22 and at its upper end to an eccentric 26 on a driven rotary main shaft 28 that is journalled longitudinally in bearing blocks 30 mounted in the head 14. Secured to the lower end of the push rods 22 is a needle bar 32 which carries a multiplicity of transversely extending needles 34 in a manner that will hereinafter become clear from this description. The needles are adapted to penetrate the fabric F on the needle plate 16 upon reciprocation of the needle bar to cooperate individually with a multiplicity of hooks (not illustrated) for forming tufts in a conventional manner.

In order to mount the multiplicity of needles at fine gauge spacing, the needle bar of the present invention includes a channel 36 defined by oppositely facing longitudinally extending walls 38 and 40 and longitudinally extending top wall 42. The channel may be formed by conventional methods such as milling and is open at the bottom facing the bed 12 and the fabric F. Opening into the channel from each wall 38 and 40 are a multiplicity of respective tapped bores 44 and 46 and from the top wall 42 are a plurality of bores 48 having counterbored holes 50 at the upper most portion for purposes which will hereinafter become clear.

Positioned within the channel 36 is an insert 52 of substantially equal depth as the channel so that the bottom surface 54 of the insert is substantially co-planar with the bottom surface 56 of the needle bar, but is narrower in width than the spacing between the walls 38 and 40. The insert preferably includes a multiplicity of grooves 58 and 60 on the respective longitudially extending sides facing the walls 38 and 40. The grooves 58 and 60 preferably extend the full depth of the insert from the bottom surface 54 to the top where it abuts the wall 42 of the needle bar channel. It should be understood that the grooves may be formed on only one side of the insert but for fine gauge tufting machines it is conventional to have two rows of needles with each row offset from the other row to give a staggered needle arrangement so that between each pair of needles in one row there is a needle positioned in the other row. Thus, as illustrated the grooves 58 are offset longitudinally from the grooves 60.

In order to secure the insert 52 to the needle bar 32, a shoulder screw 62 is positioned within each of the bores 48–50 and threaded into tapped holes 64 formed in the central portion of the insert. The needles 34 are thereafter positioned in the grooves and a set screw 66 is threaded into each of the bores 44 and 46 to abut and secure the respective needles. The spacing and positioning of the bores 44 and 46 are of course such that the set screws 66 are aligned with the respective grooves 58 and 60.

It should thus be clear that a new needle bar has been described which does not require the drilling of holes for mounting the needles. Since the grooves may be formed by milling the spacing accuracy may be very closely controlled, and yet the needle bar may be economically produced.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is.

1. A needle bar for a tufting machine or the like for supporting a multiplicity of needles for reciprocable movement toward and away from a backing, each of which needles includes a shank portion, said needle bar comprising a longitudinally extending body portion having an open faced channel extending longitudinally therein and facing said backing, an insert secured in said channel spaced from at least one longitudinally extending wall thereof, said insert having a multiplicity of needle shank accommodating grooves extending in the direction of reciprocation of said needle and facing said longitudinally extending wall, and means for securing each shank intermediate a respective groove and said wall.

2. A needle bar as recited in claim 1 wherein said insert is spaced from both longitudinally extending walls of said channel and includes a multiplicity of needle shank accommodating grooves facing each of said walls, the grooves facing a first of said walls being offset longitudinally from the grooves facing the other of said walls.

3. A needle bar as recited in claim 2 wherein said channel and insert are substantially rectangular transverse to the longitudinally extending walls and in the direction parallel to the reciprocable movement of said needles, and said grooves are substantially parallel to said walls.

* * * * *